US011754361B2

(12) United States Patent
Palenik, II

(10) Patent No.: US 11,754,361 B2
(45) Date of Patent: Sep. 12, 2023

(54) SYSTEMS, METHODS, AND APPARATUS FOR RECOIL MITIGATION

(71) Applicant: Richard Allen Palenik, II, Henderson, NV (US)

(72) Inventor: Richard Allen Palenik, II, Henderson, NV (US)

( * ) Notice: Subject to any disclaimer, the term of this patent is extended or adjusted under 35 U.S.C. 154(b) by 243 days.

(21) Appl. No.: 16/345,698

(22) PCT Filed: Oct. 30, 2017

(86) PCT No.: PCT/US2017/059126
§ 371 (c)(1),
(2) Date: Apr. 26, 2019

(87) PCT Pub. No.: WO2018/081753
PCT Pub. Date: May 3, 2018

(65) Prior Publication Data

US 2019/0353447 A1 Nov. 21, 2019

Related U.S. Application Data

(60) Provisional application No. 62/414,729, filed on Oct. 30, 2016.

(51) Int. Cl.
*F41A 21/36* (2006.01)

(52) U.S. Cl.
CPC ..... *F41A 21/36* (2013.01)

(58) Field of Classification Search
CPC ..... F41A 21/36
USPC ..... 89/14.3
See application file for complete search history.

(56) References Cited

U.S. PATENT DOCUMENTS

| | | | | |
|---|---|---|---|---|
| 2,679,192 A | | 5/1954 | Seeley | |
| 2,869,272 A | * | 1/1959 | Coyle | F41A 21/42 42/79 |
| 4,833,808 A | * | 5/1989 | Strahan | F41A 21/28 42/1.06 |

(Continued)

FOREIGN PATENT DOCUMENTS

| | | | |
|---|---|---|---|
| CN | 1053734 c | | 6/2000 |
| GB | 233709 A | | 1/1926 |
| GB | 233709 A | * | 1/1926 |

OTHER PUBLICATIONS

International Search Report dated Dec. 1, 2018 in International Application No. PCT/US2017/059126 (Filed Oct. 30, 2017).

(Continued)

*Primary Examiner* — Samir Abdosh
(74) *Attorney, Agent, or Firm* — Steven M. Santisi

(57) ABSTRACT

The present invention provides a novel gas impingement and recoil mitigation system for firearms that includes separate systems that reduce recoil, muzzle rise, and user fatigue and includes a system that is of variable size to match the size and caliber of firearm to which the system will attach. The system can attach to a variety of firearms through an appropriately sized standard barrel connector. As propellant gas is redirected through a ported barrel, the force of the over-pressure wave caused by the propellant blast impinges on a piston-like weight-and-spring mechanism, which thrusts forward with a force that is opposite in direction from the typical backward force that causes muzzle rise and recoil. Numerous additional aspects are disclosed.

15 Claims, 6 Drawing Sheets

(56) References Cited

U.S. PATENT DOCUMENTS

| | | | | |
|---|---|---|---|---|
| 8,286,541 | B2 * | 10/2012 | Lorenzut | F41A 3/56 89/190 |
| 8,910,558 | B2 | 12/2014 | Kent | |
| 10,598,458 | B1 * | 3/2020 | Cler | F41A 21/30 |
| 2012/0085225 | A1 * | 4/2012 | Vanek | F41A 5/06 89/163 |
| 2016/0123689 | A1 | 5/2016 | Maeda | |

OTHER PUBLICATIONS

Written Opinion of the International Searching Authority dated Dec. 1, 2018 in International Application No. PCT/US2017/059126 (Filed Oct. 30, 2017).

* cited by examiner

SYSTEMS, METHODS, AND APPARATUS FOR RECOIL MITIGATION

RELATED APPLICATIONS

The present application claims priority to International Application PCT/US17/59126 filed Oct. 30, 2017 and entitled "SYSTEMS, METHODS, AND APPARATUS FOR RECOIL MITIGATION" which claims priority to U.S. Provisional Application 62/414,729 filed on Oct. 30, 2016 and entitled "GAS IMPINGEMENT RECOIL MITIGATION DEVICE SYSTEM FOR FIREARMS," which are both hereby incorporated herein by reference for all purposes.

FIELD

Embodiments of the present invention relate to firearms and other projectile launching devices. More particularly, embodiments relate to systems, methods and apparatus for mitigating recoil.

BACKGROUND

Firearms have existed for hundreds of years, and nearly since inception, users of firearms have looked to improve the functionality, performance, accuracy, and stability of the firearm. In recent years, the number and type of firearms for military and personal use have increased, as has the focus on developing a superior and user-friendly firearm. When using a firearm, one of the most difficult, and crucial tasks is maintaining accuracy when firing in rapid succession. Recoil can contribute to this difficulty. A conventional method to reduce recoil is by making the firearm heavier, including adding heavy metals inside the firearm such as mercury recoil reducers. Other conventional methods used to reduce recoil involve the use of spring, hydronic or rubber recoil pad buffer systems.

Gas-operation is a system used to provide energy to actuate autoloading firearms. In gas-operation firearm systems, a portion of expelled high-pressure gas from the cartridge being fired is used to power a mechanism to both extract the spent case and insert a subsequent cartridge into the chamber. Thus, existing systems have rerouted the high-pressure gas through a tube for this purpose, but generally not for improving the accuracy and stability of the firearm, and much less for mitigating recoil. Instead as noted above, attempts to mitigate and control recoil typically have included internal springs or external appendages to reduce the impact from the recoil. These efforts have included adding padding inside or outside of the buttstock that is conventionally used in rifles.

In yet other systems, the recoil force is simply redirected in a downward direction instead of toward the user. Such systems reduce some of the recoil, but are insufficient to reduce most of the recoil. These systems are also specific to only one type of firearm, and are not universally adaptable to other types. Therefore, what is needed are improved systems, methods and apparatus for recoil mitigation.

SUMMARY

In some embodiments, a recoil mitigation system is provided. The recoil mitigation system includes a ported barrel coupleable to a firearm and including one or more ports; a housing coupled to the one or more ports and adapted to receive gas from the ported barrel when the ported barrel is coupled to a discharged firearm; and a piston disposed within the housing and adapted to move within the housing in response to gas received from the ported barrel. The movement of the piston counter balances recoil generated from discharging the firearm.

In some other embodiments, a firearm including recoil mitigation is provided. The firearm includes a ported barrel including one or more ports; a housing coupled to the one or more ports and adapted to receive gas from the ported barrel when the firearm is discharged; a piston disposed within the housing and adapted to move within the housing in response to gas received from the ported barrel; and a piston bumper disposed within the housing and adapted to stop motion of the piston. Stopping the movement of the piston counter balances recoil generated from discharging the firearm.

In yet other embodiments, a method of mitigating recoil is provided. The method includes directing gas from a discharged cartridge in a firearm from a ported barrel into a housing; driving a piston disposed within the housing to move in a direction opposite to a direction of a recoil force on the firearm in response to the gas impinging upon the piston; and stopping the piston within the housing to create a force to counter balance the recoil force.

Still other features, aspects, and advantages of embodiments will become more fully apparent from the following detailed description, the appended claims, and the accompanying drawings illustrating a number of example embodiments and implementations, including the best mode contemplated for carrying out the embodiments. Embodiments may also be capable of other and different applications, and several details may be modified in various respects, all without departing from the spirit and scope of the disclosed embodiments. Accordingly, the drawings and descriptions are to be regarded as illustrative in nature, and not as restrictive. The drawings are not necessarily drawn to scale.

BRIEF DESCRIPTION OF THE DRAWINGS

Some embodiments of the present invention are illustrated as examples and are not limited by the figures in the accompanying drawings.

DESCRIPTION

Figure 1A:
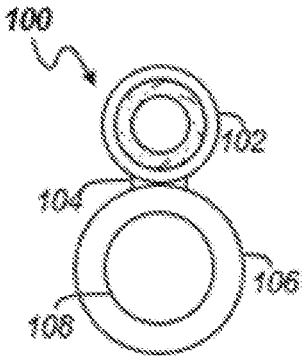
FIG. 1A depicts a front plain view of an example recoil mitigation device according to various embodiments of the invention.

Embodiments of the present invention provide systems for, and methods of, redirecting expelled gas from a discharged cartridge into an internal mechanism adapted to reduce both muzzle rise and recoil as well as user fatigue. Embodiments include two distinct configurations and numerous variations of these configurations. In a first configuration, an external parallel tube in fluid communication with the barrel of the firearm is used to redirect some of the expelled gas from a discharged cartridge into a recoil mitigation and impingement system. Other embodiments of the present invention can include a gas impingement recoil mitigation device that is fully incorporated into the design and construction of a firearm.

In some embodiments, the propellant gas is redirected through the tube coupled to the barrel, from the barrel via porting. The rear of the barrel with porting is attached to the front of the firearm through a threaded muzzle or thread adapter. The force of the over-pressure wave caused by the propellant blast impinges on a piston-like weight-and-spring mechanism. In response, the mechanism is thrust forward with a force that is opposite in direction from the typical backward force that causes muzzle rise and recoil. This action creates stabilization for maximum accuracy, and reduces shooting fatigue.

This embodiment can accommodate lower caliber rounds with lower volumes of gas and higher caliber rounds with greater volumes of gas, creating the same reliable stabilization experience therein. A two-fold benefit is realized by this embodiment in that the impact, from the onset through a counter balance measure, is reduced such that the original magnitude of recoil force toward the user is never fully realized. The embodiment provides a counter balance force in a forward motion direction that is opposite of the typical backward recoil motion direction. The counter balance occurs within the system giving the effect that recoil is cancelled and/or mitigated, and muzzle rise and recoil are controlled.

A second configuration includes a concentric gas pressure cone-shaped impingement and recoil mitigation device for firearms that is adapted to reduce muzzle rise and recoil as well as user fatigue. The concentric cone configuration redirects some of the propellant gas through a ported barrel housed within the gas pressure cone. The high-pressure gas impinges on a recessed toroid-shaped piston, pushing the piston against a piston spring, and then against a piston bumper. The force of the over-pressure wave caused by the propellant blast is directed toward the captured piston-like weight-and-spring mechanism. The mechanism thrusts forward with a force that is opposite in direction from the typical backward force that causes muzzle rise and recoil. The cone configuration of embodiments of the present invention creates stabilization for maximum accuracy, and reduces shooting fatigue by avoiding subjecting the user to repeated recoil force.

This embodiment can accommodate lower caliber rounds with lower volumes of gas and higher caliber rounds with greater volumes of gas, creating the same reliable stabilization experience therein. The cone configuration of embodiments of the present invention provides a two-fold benefit in that it reduces the recoil force, from the onset through a counter balance measure, such that the original magnitude of the force imparted to the user is never fully realized. The concentric cone configuration of embodiments of the present invention provides a counter balance force in a forward direction that is opposite of the typical backward recoil motion. The counter balance occurs within the system giving the effect that recoil is cancelled and/or mitigated, and muzzle rise and recoil is controlled.

The embodiments of the present invention satisfy a need existing in the field for a recoil mitigation device for firearms that is capable of reducing muzzle rise and recoil as well as user fatigue via a device adapted to be universally employed by various shapes and sizes of firearms with various calibers of projectiles.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing embodiments of the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

New gas impingement and recoil mitigation systems for firearms and methods for reducing recoil, muzzle rise, and reducing user fatigue are discussed herein. In the following description, for purposes of explanation, numerous specific details are set forth in order to provide a thorough understanding of the present invention. It will be evident, however, to one skilled in the art that the present invention may be practiced without these specific details. Further, the present disclosure is to be considered as depicting examples of the invention, and is not intended to limit the invention to the specific embodiments illustrated in the figures or description below. Wherever possible, reference numerals that refer to a particular view of a feature or structure in one drawing are re-used to identify the same feature or structure in another drawing. Likewise, features depicted in one embodiment that have similar, analogous, or corresponding features in another embodiment are identified with reference numerals that only differ by the inclusion of a prime symbol (').

Figure 1B:
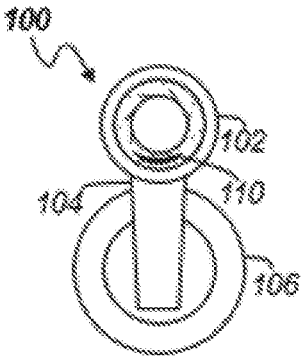
FIG. 1B depicts a rear plain view of an example recoil mitigation device according to various embodiments of the invention.
Figure 2:
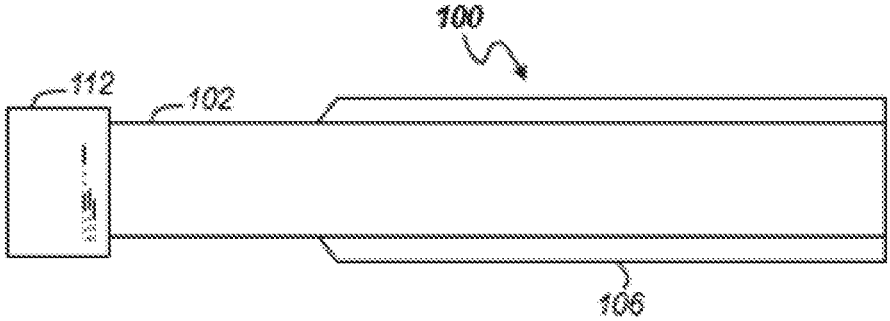
FIG. 2 depicts a top plain view of an example recoil mitigation device according to various embodiments of the invention.
Figure 3:
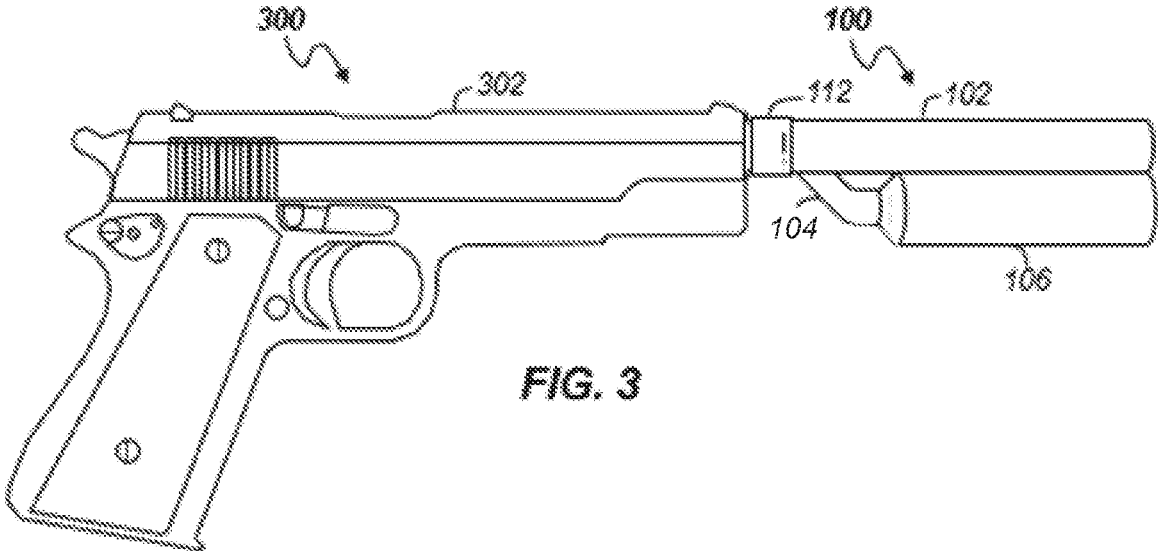
FIG. 3 depicts a side plain view of an example recoil mitigation device installed on a firearm according to various embodiments of the invention.

Embodiments of the present invention will now be described with reference to the appended drawings representing various alternative embodiments. Turning to FIGS. 1A and 1B, front and rear end views, respectively, of a first example recoil mitigation system 100 are depicted. FIGS. 2 and 3 depict top and side views of the example recoil mitigation system 100 with the system 100 installed on a firearm 302 in FIG. 3. With reference to all four views, a ported barrel 102, adapted to be coupled to a firearm 302, includes one or more ports 110 coupled to a gas tube 104. The gas tube 104 is coupled to and in fluid communication with a piston housing 106. The gas tube 104 is adapted, disposed and sized to direct gas discharged from a cartridge in the firearm 302 from the barrel 102 of the recoil mitigation system 100 into the gas tube 104 via the one or more ports 110 and then onto the piston housing 106 to move a piston (not shown in FIGS. 1A-3 but see piston 402 in FIG. 4) toward the piston bumper 108. The example cylindrical ported barrel 102 with porting 110, is intended to represent a variety of possible barrel embodiments (e.g., having different sizes and shapes) that can be coupled to the firearm barrel using a variety of standard barrel connectors 112, further representing applicable varieties of sizes and styles of firearms with which embodiments of the present invention can be used. For example, embodiments can be used with handguns, rifles, shotguns, automatic weapons, etc.

Note that the front view of FIG. 1A illustrates four of the exterior visible components 102, 104, 106, 108 of the example recoil mitigation system 100 and each can be manufactured using any practicable type of metal or material that can withstand the high heat and pressure that results from use of a firearm. In some embodiments, the ported barrel 102 can be detachably coupled (e.g., to facilitate ease of cleaning) to the piston housing 106 via friction pins, one or more channel locks, a tongue and groove system, a dove tail system, one or more locking rings, one or more clamps, other couplings, etc. In some other embodiments, the ported barrel 102 can be permanently coupled (e.g., to enhance durability) to the piston housing 106 via welding or be integrally formed via, e.g., a singular molding, or milled from a single block of material, or produced by other means (e.g., 3D printing).

Note also that the system 100 is not limited to use on any certain type or style of firearms and may be sized and adapted for each specific application. In some embodiments, the piston housing 106 is cylindrical and can be sized at a multiple of approximately two times the diameter of the barrel 102. Note that this example relative dimension can be selected based upon the variety and model of the intended firearm.

The rear view shown in FIG. 1B depicts the barrel 102 with gas port 110 coupled to the gas tube 104 and the piston housing 106. The gas port 110, is an opening in the ported barrel 102, and is disposed at the beginning of the gas tube 104. The gas tube 104, can also be cylindrical, and extends at an angle to reach the center of the piston housing 106. In some embodiments, the angle can be approximately 45 degrees but other angles in the range of approximately 20 degrees to approximately 70 degrees can be used. The angle of the gas tube 104 may vary further depending upon the perimeters and caliber of the firearm to which the system is to be attached.

In some embodiments, the ported barrel 102 can be scalable such that it can, but is not required to, closely match the length of the piston housing 106. The barrel length is preferably short enough to avoid encumbering the shooter by creating too much excess weight and thereby creating additional shooter fatigue. The piston housing is selected to accommodate the size and length of piston housing components (i.e., a recessed center recoil piston, a piston spring, a piston bumper) to successfully complete its intended function which includes providing a sufficient force in the direction opposite the recoil force to counter-balance the recoil force and thereby mitigate it. Note that in order to cancel and/or mitigate the recoil force (i.e., sufficiently counter-balance it so that the net force acting on the firearm during discharge is substantially reduced) the piston, having a selected mass, is driven into the bumper with an amount of force based upon the muzzle energy of the firearm and cartridge.

FIG. 2 illustrates the top view of the example recoil mitigation system 100. In this drawing, the ported barrel 102 over the piston housing 106 and the barrel connector 112 are visible. The ported barrel 102, which is a cylindrical and vacant tube, can be specifically and individually sized to match any firearm type, size, and size of various caliber projectiles. Similarly, the piston housing 106, can also be embodied as a cylindrical tube, or other shape.

FIG. 3 illustrates an exterior side assembled view of a recoil mitigation system 100 mounted on an example firearm 302. The ported barrel 102, the gas tube 104, the piston housing 104, and the standard barrel connector 108 are visible. This view illustrates an example of how this embodiment can be connected to a variety of differently shaped and sized firearms using a standard barrel connector 108.

Figure 4:
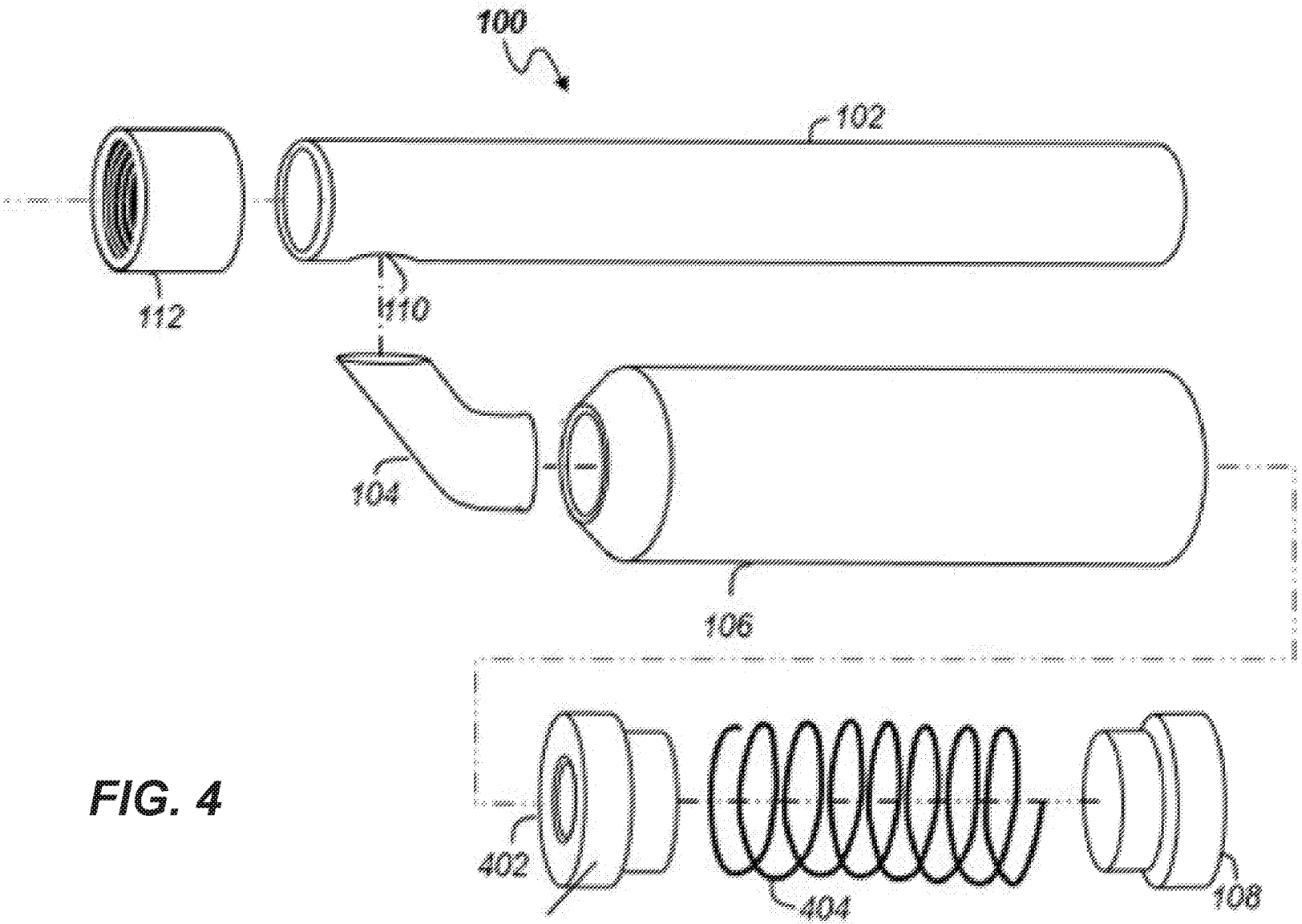
FIG. 4 depicts an exploded perspective view of an example recoil mitigation device according to various embodiments of the invention.

Turning now to FIG. 4, an exploded perspective view illustrates the assembly and relative position of the barrel 102, the gas tube 104, the piston housing 106, the gas port 110, the barrel connector 112, a recessed center recoil piston 402, a piston spring 404, and the piston bumper 108. The barrel connector 112 can connect the system 100 to the barrel 102 via threading. Note that the port 110 represented by an "indent" on the lower portion of the ported barrel 102 can be disposed on a lower surface of the barrel 102 as shown. However, in some embodiments, the port 110 can be disposed on the top or sides of the barrel 102. The gas port 110 enables the flow of propellant gas into the gas tube 104, and the gas tube 104, is directly connected to the piston housing 106. The piston housing 106 contains a recessed center recoil piston 402, which is connected to a piston spring 404. The other end of the piston spring 404 is attached to the piston bumper 108. The recessed center recoil piston 402 is movable, and is pushed toward the piston bumper 108 by the high-pressure discharge from the cartridge. The piston spring 404 pushes the recessed center recoil piston 402 back toward the initial position for subsequent mitigation action. The piston bumper 108 is stationary.

In operation, the propellant gas enters the barrel 102 of the recoil mitigation system 100 from the firearm's barrel. Note that in some embodiments, the combined length of the gas tube 104 and piston housing 106 can extend to the length of the barrel 100 or longer. The method of operation begins once a live round is fired, and the propellant gas is redirected from the barrel 100 through the gas port 106 and into the gas tube 104, and is channeled toward the recessed center recoil piston 402. The over-pressure wave and the force of the expressed gas impinges on the recessed center recoil piston 402, which is then thrust forward from an initial position, compressing the piston spring 404 forward until it engages with the piston bumper 108. When the recessed center recoil piston 402 collides with the piston bumper 108 or compresses the spring 404 and stops, kinetic energy is transferred such that the firearm 302 lurches forward in an action that is opposite to the backwards motion of recoil that would otherwise be experienced by the shooter.

Note that the surface area of the recessed center recoil piston 402 (and consequently the diameter of the piston housing 106) is selected to be large enough to be responsive to the available gas pressure. Likewise, the mass of the piston 402 is selected to be able to generate sufficient force to counter-balance the recoil force using the available gas pressure (or muzzle energy) from the propellant gas. Once the piston 402 stops, the spring 404 then returns the piston to the initial position. In some embodiments, the spring 404 can have a spring force constant selected to return the piston 402 to the initial position at a rate sufficiently fast enough to support counter-balancing recoil from a subsequent round as soon as the firearm is capable of discharging the subsequent round.

In some embodiments, the recessed center recoil piston 402 can use a variety of sealing materials, such as lubricants that can withstand the heat and friction and motion occurring within the piston housing 106, or other materials such as gaskets, washers, oils, bearings, etc. In some embodiments, a recess in the recoil piston 402 can be deep enough to improve the system's ability to use the available gas pressure to drive the piston 402.

Note that throughout the description, the references "upper", "lower", "left" and "right" are used herein merely for purposes of orienting and clarifying the various parts in how they are depicted in the drawings and should not be taken as limiting or requiring the features to have a particular orientation.

Figure 5A:
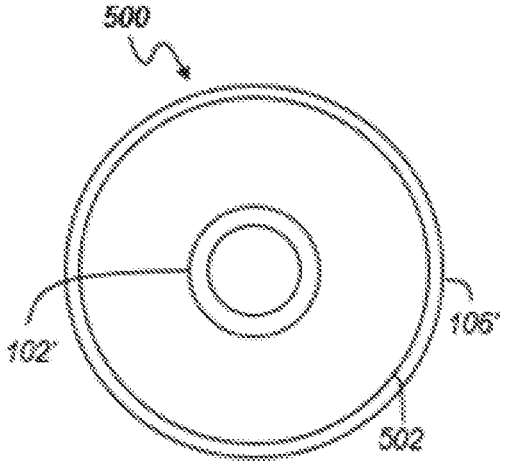
FIG. 5A depicts a front plain view of a second example recoil mitigation device according to various embodiments of the invention.
Figure 5B:
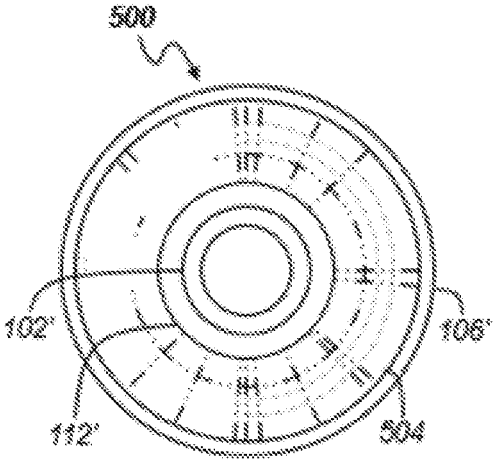
FIG. 5B depicts a rear plain view of the second example recoil mitigation device according to various embodiments of the invention.

FIGS. 5A and 5B illustrate front and rear plain views (respectively) of a second example of a gas impingement and recoil mitigation system 500 for firearms according to various embodiments described herein. This embodiment includes a concentric cone 504 disposed around a ported barrel 102' that directs gas from a plurality of ports 510 (see FIG. 6B) toward the piston 506 within the piston housing 106' to drive the piston 506 (see FIG. 6B) toward the piston bumper 502 (e.g., note that the quantity of ports can be variable from a range of one port to many ports (e.g., 20)). In other embodiments, the barrel can be eliminated, such as in a suppressor, whereas the gas expands in a vacant and unobstructed space within the device. In some embodiments, the ported barrel 102', can extend beyond the piston bumper 502, or can be shorter in length, or flush with the piston bumper 502. The rear view of FIG. 5B depicts the ported barrel 102', the piston housing 106', the barrel connector 112', and the gas pressure cone 504.

Figure 6A:
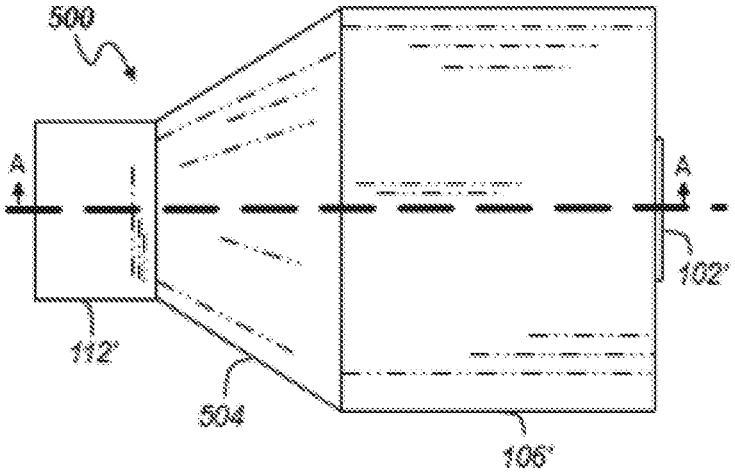
FIG. 6A depicts a top plain view of the second example recoil mitigation device according to various embodiments of the invention.
Figure 6B:
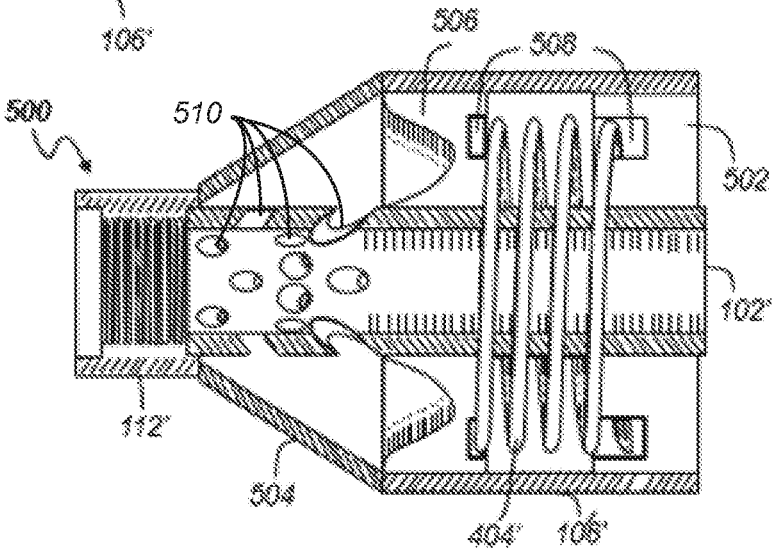
FIG. 6B depicts a side cross-sectional view (taken along line AA in FIG. 6A) of the second example recoil mitigation device according to various embodiments of the invention.

FIG. 6A illustrates an exterior top view of the system 500, and depicts the ported barrel 102' extending slightly beyond the piston housing 106' and the barrel connector 112' coupled to the gas pressure cone 504. FIG. 6B includes a cross-sectional view of the system 500 taken along line AA in FIG. 6A. Examples of the ports 510 in the ported barrel 102' within the piston housing 106', the barrel connector 112', the piston spring 404', the gas pressure cone 504, the recessed torus-shaped piston 506 and torus-shaped piston bumper 502, both with spring channels 508 are each illustrated in FIG. 6B. The ported barrel 102' illustrates an example of specialized ports 510 for the system 500 that are angled and radially disposed to evenly distribute and direct gas toward the torus-shaped piston 506 which can include recesses or cavities as shown to capture gas from the ports 510 so that the piston 506 is propelled toward the torus-shaped piston bumper 502 by the gas. The ports 510 can be arranged in an evenly distributed pattern around the circumference of the ported barrel 102' to distribute the gas flow and optimally direct it at the piston 506 so that the piston 506 is uniformly, evenly, and consistently pushed toward the piston bumper 502.

As with the example system 100 described above, the system 500 of FIGS. 5A to 6B is not limited to a particular type or style of firearm, and may be sized for each specific application. The barrel connector 112', is attached to the ported barrel 102', which is housed inside the gas pressure cone 504 and the piston housing 106'. The gas pressure cone 504, is conical in shape, and is coupled to the piston housing 106'. In some embodiments, the cone 504 can be conically-shaped, parabolically-shaped, trumpet-shaped, bell-shaped, dome-shaped, tapered-shaped, or compound contoured-shaped (e.g., with an "S" or ogee shape) to enhance or adjust gas pressurization and flow as it impinges upon and drives the piston 506. The piston spring 404' can be a coil that wraps through the spring channel 120 in both the recessed piston 506 and the piston bumper 502. The spring 404' can have a spring force constant selected to return the piston 506 to the initial position at a rate sufficiently fast enough to support counter-balancing recoil from a subsequent round as soon as the firearm is capable of discharging the subsequent round.

From an interior perspective, the propellant gas enters the barrel with porting 100, which runs the length of the system 500. In operation, once a live round is fired, the propellant gas is redirected from the ported barrel 102' through the ports 510, and is channeled through the gas pressure cone 504 until it reaches the recessed torus-shaped piston 506. The over-pressure wave and the force of the expressed gas impinges with the recessed torus-shaped piston 506, which compresses the piston spring 404' moving the recessed torus-shaped piston 506 forward until it engages with the piston bumper 502 or is stopped by the spring 404'. When the recessed torus-shaped piston 506 collides with the piston bumper 502 or is stopped, kinetic energy is transferred such that the firearm is pushed forward in a direction that is opposite to the backwards force of recoil that would otherwise be experienced by the shooter. The piston spring 404' is movable through compression and decompression inside the piston housing 106' such that the recessed torus-shaped piston 506 is returned back to the starting position after being stopped.

Figure 7:
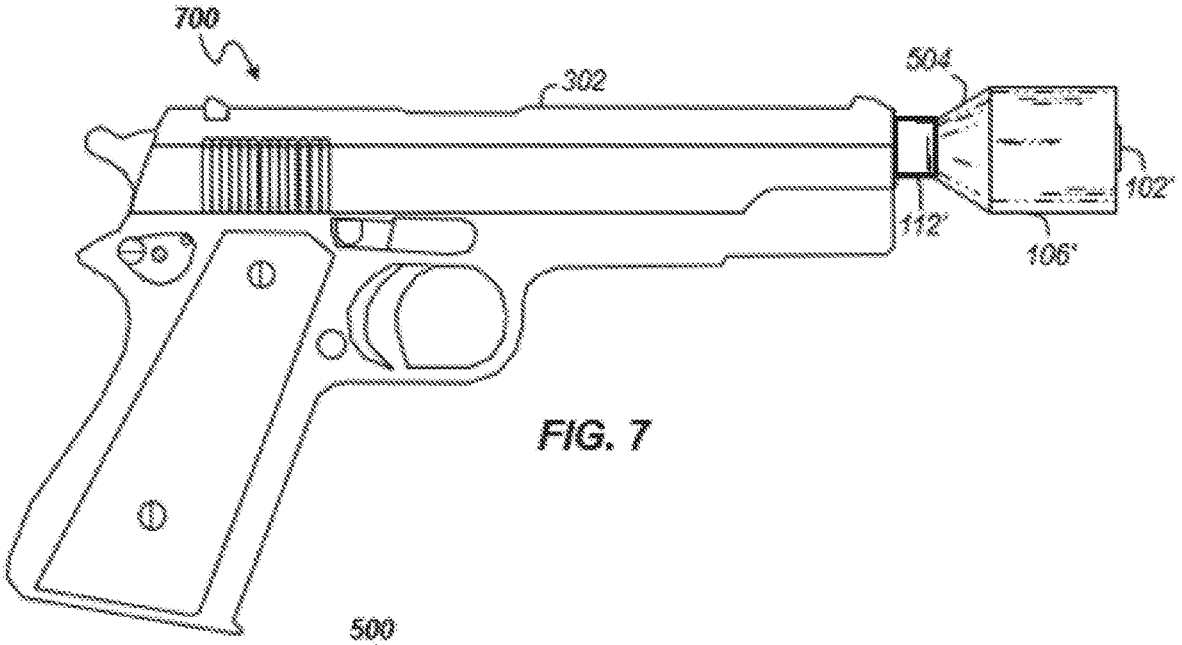
FIG. 7 depicts a side plain view of the second example recoil mitigation device installed on a firearm according to various embodiments of the invention.

FIG. 7 illustrates an exterior side view of the system 500 mounted on an example firearm 302, and depicts the ported barrel 102', the piston housing 106', the barrel connector 112', and the gas pressure cone 504.

Figure 8A:
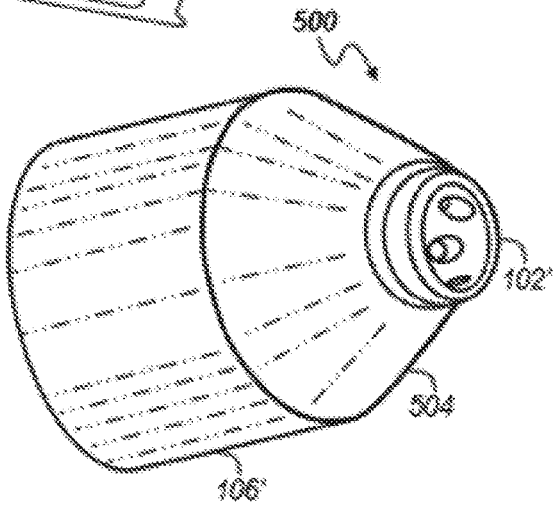
FIG. 8A depicts a rear perspective view of the second example recoil mitigation device according to various embodiments of the invention.
Figure 8B:
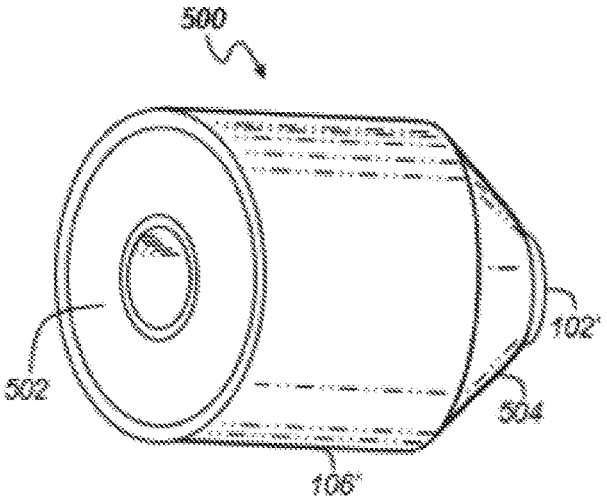
FIG. 8B depicts a front perspective view of the second example recoil mitigation device according to various embodiments of the invention.

FIGS. 8A and 8B illustrate a perspective rear and front exterior view (respectively) of the system 500. The perspective rear view of FIG. 8A depicts the ported barrel 102', the piston housing 106', and the gas pressure cone 504. The perspective front view of FIG. 8B depicts the ported barrel 102', the piston housing 106', the piston bumper 502, and the gas pressure cone 504. This view of the system 500 illustrates an example of the system 500 with a conical shape, but as noted above, other shapes are possible. Also, as in the example embodiment in the system 100 described above, the components of the system 500 can be selected to achieve the recoil counter-balancing function with respect to selection of materials, seals, mass, dimensions, shapes, and geometries.

Figure 9:
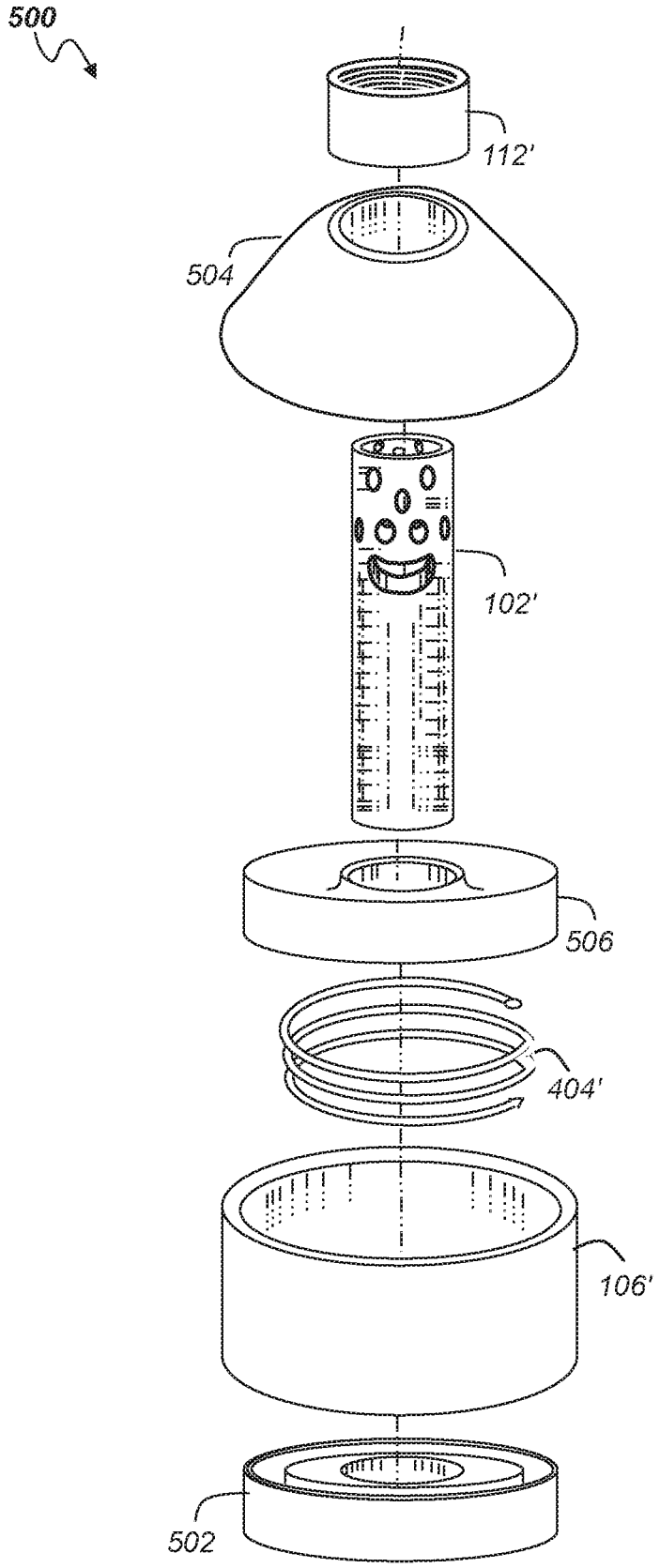
FIG. 9 depicts an exploded perspective view of the second example recoil mitigation device according to various embodiments of the invention.

FIG. 9 illustrates a perspective exploded view of the system 500, and depicts the ported barrel 102', the piston housing 106', the barrel connector 112', the piston spring 404', the piston bumper 502, the gas pressure cone 504, and the recessed torus-shaped piston 506. The illustration shows the assemblage of the system 500 in a perspective view.

Figure 10:
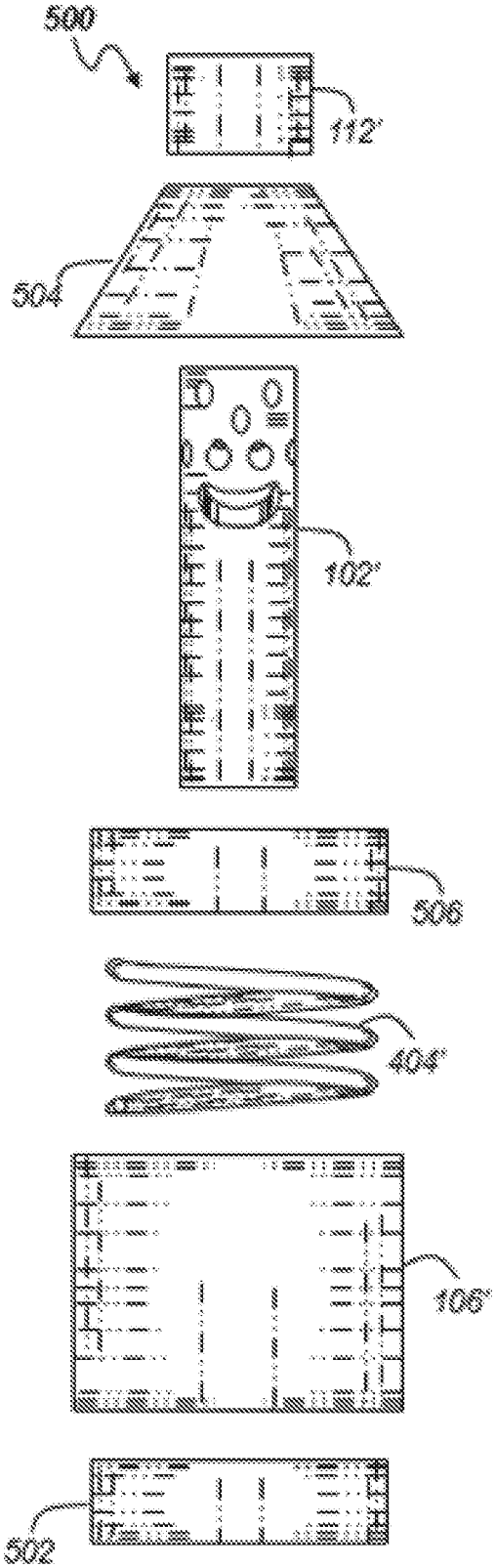
FIG. 10 depicts an exploded exterior side view of the second example recoil mitigation device according to various embodiments of the invention.
Figure 11:
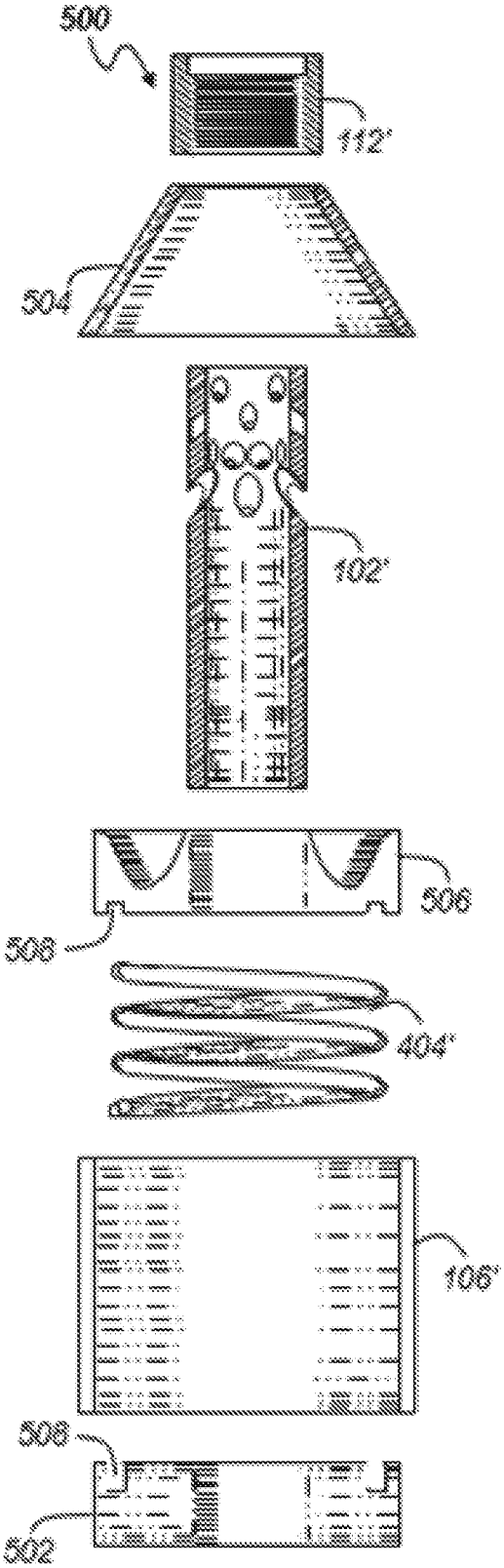
FIG. 11 depicts an exploded cut-away side view of the second example recoil mitigation device according to various embodiments of the invention.

FIG. 10 illustrates an exploded exterior side view of the system 500 and FIG. 11 illustrates an exploded cross-sectional view of the system 500. Both drawings depict the ported barrel 102', the piston housing 106', the barrel connector 112', the piston spring 404', the piston bumper 502, the gas pressure cone 504, and the recessed torus-shaped piston 506.

The various embodiments of the recoil mitigation system 100, 500 include several novel features. For example, the ported barrel 102, 102' is scalable and can accommodate a wide variety of ammunition calibers, and can be connected to varying sizes of firearms. The gas tube 104 and the ports 510 redirect propellant gas away from the ported barrel 102, 102' such that the systems 100, 500 receive the expelled force and redirects it away from the shooter. Depending upon the size and strength of the shooter, the duration of the shooting session, and the size of the ammunition used, a shooter can experience less fatigue, can gain accuracy, and can save ammunition due to the greater accuracy, as a result of the reduction in muzzle rise and recoil of embodiments of the present invention.

Embodiments provide a novel solution to dynamically counter-balance recoil via the action in the piston housing, which generally is achieved by a recoil piston being driven from an initial position toward a piston bumper by gas redirected from the firearm's barrel and retuned to the initial position by a piston spring. When the gas is redirected through the gas port and into the gas tube or cone, the propellant forces the piston to move forward and the spring compresses such that the otherwise backward recoil is forced forward into the piston bumper, and this action stabilizes the firearm and makes the shooter feel less rise, recoil and fatigue.

Embodiments are scalable and as long as there is propellant gas present, the device can be deployed for use. The device can be sized for any type of firearm or weaponry that is involved with expelling propellant gas. When used with mounted, instead of free-standing or, weapons, such as those found on a gun ship or in artillery, the invention can reduce metal fatigue, and reduce maintenance costs from the harsh blowback that naturally occurs.

Similarly, embodiments can be applied to the smallest of free-standing firearms aiding even the inexperienced shooter in reducing fatigue, and increasing accuracy.

The spring serves to return the piston to its starting position. In some embodiments, the spring can be replaced by other biasing means such as a pneumatic actuator, a hydraulic actuator, a magnetic array, electrical or other mechanical methods. No matter the solution, whether solved by using the spring or alternative means, the timing of when the piston hits the bumper will be complimentary to the shooter's rate of fire. The recoil force is counterbalanced by the force of the piston.

In some embodiments, a linear motion bearing, a pillow-type bearing, or other type of bearing, can be employed to guide the piston, which would further aid the movement of the piston traveling the length of the barrel.

In some embodiments, a suppressor hybrid (e.g., the system 100, 500 combined with a suppressor) with baffles located preferably after the piston bumper can be employed. The addition of a suppressor enhances operation of the system wherein offensive and harmful sound is also mitigated.

In some embodiments of the system 100, a fluted tube configuration can be employed where instead of one gas port leading into the gas tube, there is a series of, or sequence of multiple sequentially placed gas ports such that excess propellant gas can be expelled across the trail of angled flute-style ports. These ports can include metal gutters that directionally focus the gas from an inner-interior perspective. This method enables additional volumes of gas potentially further reducing recoil, rise, and user fatigue.

In some embodiments, varying types of tracks in the device or piston housing are employed to further enable a smooth gliding motion of the piston. In some embodiments, alternative shapes of the components are used relative to those described herein, such as curved, domed, trumpeted, convex, concave, angular, tapered, and so on. The components of the invention can be manufactured in a variety of shapes, which are different from the illustrated shapes, and parts such as the piston housing, piston bumper, piston spring, etc., could be square, triangular, hexagonal, rectangular, etc.

In some embodiments, the system can be integrally formed with the barrel of the firearm by the firearm manufacturer instead of being an addon type system that is applied to a firearm by a user. In such embodiments, the system 100, 500 can be incased and/or contained internally within the firearm.

Similar to a self-cleaning oven, the heat resident within the system during operation can be high enough that conventional residue from shooting is incinerated and eliminated. Thus, embodiments of the invention can reduce the frequency of cleaning cycles and increase the reliability of the firearm due to reduced debris build-up. In any case, materials used are selected to withstand the vast range of heat, pressure, and force, and muzzle energies (e.g., 10 Joules for air guns to 32,000 Joules for heavy artillery) found in firearms and cartridges used with the system 100, 500.

Embodiments of the invention enhance a firearm's ease of use, and due to the simple structure, can be assembled and disassembled by a novice operator. Further, a variety of embodiments can be manufactured using tension pins, fasteners, and many normal and customary methods for firearm components and or peripherals.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications.

Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed embodiments.

The term "product" means any machine, manufacture and/or composition of matter as contemplated by 35 U.S.C. § 101, unless expressly specified otherwise.

Each process (whether called a method, procedure, or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component, structure, or article is described herein, more than one device, component, structure or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component, structure, or article is described herein (whether or not they cooperate), a single device, component, structure, or article may alternatively be used in place of the more than one device, component, structure, or article that is described. For example, a plurality of devices may be substituted with a single device. Accordingly, the various functionality that is described as being possessed by more than one device, component, structure, or article may alternatively be possessed by a single device, component, structure, or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

Embodiments include a recoil mitigation system including a ported barrel coupleable to a firearm and including one or more ports; a housing coupled to the one or more ports and adapted to receive gas from the ported barrel when the ported barrel is coupled to a discharged firearm; and a piston disposed within the housing and adapted to move within the housing in response to gas received from the ported barrel, wherein stopping the movement of the piston counter balances recoil generated from discharging the firearm. The system can further include a connector adapted to allow the ported barrel to couple to the barrel of the firearm. The system can further include a gas tube coupling the housing to a port in the ported barrel and providing a channel for fluid communication between the ported barrel and the housing. Alternatively, the ported barrel can include a plurality of angled ports disposed radially and evenly distributed around a portion of the ported barrel. The system can further include a gas pressure cone disposed around the portion of the ported barrel including the plurality of angled ports. The gas pressure cone can have at least one of a conical shape, a parabolic shape, a trumpet shape, a bell shape, a dome shape, a tapered shape, an ogee shape, and a compound contour shape. The gas pressure cone is coupled to the housing. The system can further include a piston bumper disposed at a distal end of the housing and adapted to stop motion of the piston. The system can further include a piston spring disposed between the piston and the piston bumper and adapted to stop motion of the piston.

In some embodiments, a firearm including recoil mitigation is provided. The firearm can include a ported barrel including one or more ports; a housing coupled to the one or more ports and adapted to receive gas from the ported barrel when the firearm is discharged; a piston disposed within the housing and adapted to move within the housing in response to gas received from the ported barrel; and a piston bumper disposed within the housing and adapted to stop motion of the piston. Stopping the movement of the piston counter balances recoil generated from discharging the firearm. The firearm can further include a gas tube coupling the housing to a port in the ported barrel and providing a channel for fluid communication between the ported barrel and the housing. The ported barrel can include a plurality of angled ports disposed radially and evenly distributed around a portion of the ported barrel. The firearm can further include a gas pressure cone disposed around the portion of the ported barrel including the plurality of angled ports. The gas pressure cone can have at least one of a conical shape, a parabolic shape, a trumpet shape, a bell shape, a dome shape, a tapered shape, an ogee shape, and a compound contour shape. The gas pressure cone is coupled to the housing. The firearm can further include a piston spring disposed between the piston and the piston bumper and adapted to stop motion of the piston.

Embodiments can include methods of mitigating recoil. The methods can include directing gas from a discharged cartridge in a firearm from a ported barrel into a housing; thereby driving a piston disposed within the housing to move in a direction opposite to a direction of a recoil force on the firearm in response to the gas impinging upon the piston; and stopping the piston within the housing to create a force to counter balance the recoil force. The methods can further include coupling the ported barrel to a barrel of the firearm. Directing the gas can include directing gas into the housing via a gas tube coupled to the ported barrel and the housing. Alternatively, directing the gas can include directing gas into the housing via angled ports in the ported barrel surrounded by a gas pressure cone coupled to the housing.

While preferred materials for features have been described, the device is not limited to these materials. A variety of any other practicable materials may be used for some or all of the features of various embodiments of the present invention.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

The foregoing description discloses only exemplary embodiments of the invention. Modifications of the above disclosed apparatus and methods which fall within the scope of the invention will be readily apparent to those of ordinary skill in the art. For example, although the examples discussed above are illustrated for a firearm market, embodiments of the invention can be implemented for other markets.

Accordingly, while the present invention has been disclosed in connection with exemplary embodiments thereof, it should be understood that other embodiments may fall within the spirit and scope of the invention, as defined by the following claims.

What is claimed is:

1. A recoil mitigation system comprising:

a ported barrel coupleable to a firearm and including a plurality of angled ports disposed radially and evenly distributed around a portion of the ported barrel;

a gas pressure cone disposed around the portion of the ported barrel including the plurality of angled ports:

a housing coupled to the plurality of angled ports and adapted to receive gas from the ported barrel when the ported barrel is coupled to a discharged firearm; and a piston disposed within the housing and adapted to move within the housing in response to gas received from the ported barrel, wherein stopping the movement of the piston counter balances recoil generated from discharging the firearm.

2. The system of claim 1 further comprising a connector adapted to allow the ported barrel to couple to a barrel of the firearm.

3. The system of claim 1 further comprising at least one gas tube coupling the housing to at least one of the angled ports in the ported barrel and providing a channel for fluid communication between the ported barrel and the housing.

4. The system of claim 1 wherein the gas pressure cone has at least one of a conical shape, a parabolic shape, a conical shape with a flared broad end forming a trumpet shape, a bell shape, a dome shape, a tapered shape, an ogee shape, or a compound contour shape.

5. The system of claim 1 wherein the gas pressure cone is coupled to the housing.

6. The system of claim 1 further comprising a piston bumper disposed at a distal end of the housing and adapted to stop motion of the piston.

7. The system of claim 6 further comprising a piston spring disposed between the piston and the piston bumper and adapted to stop motion of the piston.

8. A firearm including recoil mitigation, the firearm comprising:

a ported barrel including a plurality of angled ports disposed radially and evenly distributed around a portion of the ported barrel;

a gas pressure cone disposed around the portion of the ported barrel including the plurality of angled ports;

a housing coupled to the plurality of angled ports and adapted to receive gas from the ported barrel when the firearm is discharged;

a piston disposed within the housing and adapted to move within the housing in response to gas received from the ported barrel; and a piston bumper disposed within the housing and adapted to stop motion of the piston, wherein stopping the movement of the piston counterbalances recoil generated from discharging the firearm.

9. The firearm of claim 8 further comprising at least one gas tube coupling the housing to at least one of the angled ports in the ported barrel and providing a channel for fluid communication between the ported barrel and the housing.

10. The firearm of claim 8 wherein the gas pressure cone has at least one of a conical shape, a parabolic shape, a conical shape with a flared broad end forming a trumpet shape, a bell shape, a dome shape, a tapered shape, an ogee shape, or a compound contour shape.

11. The firearm of claim 10 wherein the gas pressure cone is coupled to the housing.

12. The firearm of claim 8 further comprising a piston spring disposed between the piston and the piston bumper and adapted to stop motion of the piston.

13. A method of mitigating recoil comprising:

directing gas from a discharged cartridge in a firearm from a ported barrel into a housing via angled ports in the ported barrel surrounded by a gas pressure cone coupled to the housing;

driving a piston disposed within the housing to move in a direction opposite to a direction of a recoil force on the firearm in response to the gas impinging upon the piston; and stopping the piston within the housing to create a force to counterbalance the recoil force.

14. The method of claim 13 further comprising coupling the ported barrel to a barrel of the firearm.

15. The method of claim 14 wherein directing gas includes directing gas into the housing via a gas tube coupled to at least one of the angled ports in the ported barrel and the housing.

* * * * *